US008536853B2

(12) United States Patent
Sessions

(10) Patent No.: US 8,536,853 B2
(45) Date of Patent: Sep. 17, 2013

(54) DATA RETENTION SECONDARY VOLTAGE REGULATOR

(75) Inventor: D.C. Sessions, Phoenix, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 0 days.

(21) Appl. No.: 13/601,351

(22) Filed: Aug. 31, 2012

(65) Prior Publication Data

US 2012/0326694 A1 Dec. 27, 2012

Related U.S. Application Data

(63) Continuation of application No. 12/780,471, filed on May 14, 2010, now Pat. No. 8,362,757.

(60) Provisional application No. 61/185,627, filed on Jun. 10, 2009.

(51) Int. Cl.
*G05F 3/16* (2006.01)

(52) U.S. Cl.
USPC ..... 323/313; 323/315; 323/316; 327/538; 327/540

(58) Field of Classification Search
USPC ..... 323/265, 273, 274, 275, 311–317; 327/539–543
See application file for complete search history.

(56) References Cited

U.S. PATENT DOCUMENTS

| | | | | |
|---|---|---|---|---|
| 5,087,891 | A * | 2/1992 | Cytera | 330/288 |
| 6,005,379 | A | 12/1999 | Wong et al. | 313/313 |
| 6,043,638 | A | 3/2000 | Tobita | 323/313 |
| 6,771,116 | B1 | 8/2004 | Wang et al. | 327/540 |
| 6,922,098 | B2 * | 7/2005 | Choi et al. | 327/538 |
| 7,463,013 | B2 | 12/2008 | Plojhar | 323/315 |
| 7,768,248 | B1 * | 8/2010 | Hyde | 323/315 |
| 8,013,588 | B2 | 9/2011 | Imura | 323/313 |
| 2008/0116862 | A1 | 5/2008 | Yang et al. | 323/269 |

FOREIGN PATENT DOCUMENTS

| | | |
|---|---|---|
| JP | 03131916 | 6/1991 |
| WO | 02/19074 | 3/2002 |
| WO | 2004/061830 | 7/2004 |

OTHER PUBLICATIONS

International PCT Search Report, PCT/US2010/037945, 17 pages, Mailed Oct. 8, 2010.

* cited by examiner

*Primary Examiner* — Nguyen Tran
(74) *Attorney, Agent, or Firm* — King & Spalding L.L.P.

(57) ABSTRACT

An integrated circuit device has a primary voltage regulator and an ultra-low power secondary voltage regulator. The ultra-low power secondary voltage regulator supplies voltage to certain circuits used for providing data retention and dynamic operation, e.g., a real time clock and calendar (RTCC) when the integrated circuit device is in a low power sleep mode. The primary voltage regulator provides power to these same certain circuits when the integrated circuit is in an operational mode.

5 Claims, 4 Drawing Sheets

DATA RETENTION SECONDARY VOLTAGE REGULATOR

CROSS-REFERENCE TO RELATED APPLICATIONS

This application is a continuation of U.S. patent application Ser. No. 12/780,471 filed on May 14, 2010, now U.S. Pat. No. 8,362,757 which claims priority to commonly owned U.S. Provisional Patent Application Ser. No. 61/185,627 filed Jun. 10, 2009, which are hereby incorporated by reference herein in their entirety.

TECHNICAL FIELD

The present disclosure relates to integrated circuit device voltage regulation, and, more particularly, to a low power secondary voltage regulator in parallel with and functions when a primary voltage regulator is off. The secondary voltage regulator may be used when the integrated circuit device is in a sleep mode and a regulated voltage is needed for circuits that are used to retain information that will be needed when the integrated circuit device returns to an operational mode.

BACKGROUND

Power must be supplied with minimal power consumption to circuits that retain and/or operate on data when an integrated circuit device is in a sleep mode. These circuits are powered so as to retain the data when other circuits of the integrated circuit device are in a low power sleep mode. In addition, minimal dynamic power may be supplied to circuits that operate on data during the sleep mode, e.g., a real time clock and calendar (RTCC), at minimum power consumption.

A primary voltage regulator having precision voltage regulation, e.g., a bandgap voltage reference and associated voltage regulator circuits, requires a significant amount of power that is not desirable when battery operated devices go into a low power sleep mode yet still have to maintain voltage(s) on some circuits in order to retain/operate on data.

SUMMARY

What is needed is a way to supply necessary regulated voltage(s) to those circuits in an integrated circuit device requiring power for data retention and/or minimal dynamic power for continuous operation such as, for example but not limited to, a real time clock and calendar (RTCC) when other circuits of the integrated circuit device are in a sleep mode.

According to a specific example embodiment of this disclosure, a low power voltage regulator for supplying operating voltage to circuits required to maintain data and/or be operational during an integrated circuit device low power sleep mode comprises: a first constant current source connected to a supply voltage source; a first N-channel field effect transistor (FET) having a source, a drain and a gate, wherein the drain of the first N-channel FET is connected to the supply voltage, the gate of the first N-channel FET is connected to the first constant current source and the first constant current source is connected between the gate and drain of the first N-channel FET; a second N-channel FET having a source, a drain and a gate, wherein the drain of the second N-channel FET is connected to the gate of the first N-channel FET and the first constant current source, and the source of the second N-channel FET is connected to a supply voltage common; a second constant current source connected to the supply voltage common and the gate of the second N-channel FET; a first P-channel FET having a source, a drain and a gate, wherein the drain and gate of the first P-channel FET are connected to the gate of the second N-channel FET and the second constant current source, and the source of the first P-channel FET is connected to the source of the first N-channel FET; the first and second N-Channel FETs, the first P-channel FET and the first and second constant current sources comprise a low power secondary voltage regulator having an output, wherein the output is the connected sources of the first P-channel FET and the first N-channel FET; and a maintained voltage core logic of an integrated circuit device connected to the output of the low power secondary voltage regulator. The low power voltage regulator may further comprise: a second P-channel FET having a source, a drain and a gate, wherein the drain of the second P-channel FET is connected to the sources of the first N-channel and first P-channel FETs, the gate of the second P-channel FET is connected to the drain of the second N-channel FET and the first constant current source, and the source of the second P-channel FET is connected to an output from a primary voltage regulator; wherein the maintained voltage core logic is coupled to and receives its operating voltage from the primary voltage regulator through the second P-channel FET when the integrated circuit device is in an operational mode; and wherein the maintained voltage core logic receives its operating voltage from the output of the low power secondary voltage regulator when the integrated circuit device is in a low power standby sleep mode.

According to another specific example embodiment of this disclosure, a low power voltage regulator for supplying back-up voltage to circuits required to maintain data and/or be operational during an integrated circuit device low power sleep mode comprises: a first constant current source connected to a supply voltage source; a first N-channel field effect transistor (FET) having a source, a drain and a gate, wherein the drain of the first N-channel FET is connected to the supply voltage, the gate of the first N-channel FET is connected to the first constant current source and the first constant current source is connected between the gate and drain of the first N-channel FET; a second N-channel FET having a source, a drain and a gate, wherein the drain of the second N-channel FET is connected to the gate of the first N-channel FET and the first constant current source, and the source of the second N-channel FET is connected to a supply voltage common; a second constant current source connected to the supply voltage common and the gate of the second N-channel FET; a first P-channel FET having a source, a drain and a gate, wherein the drain and gate of the first P-channel FET are connected to the gate of the second N-channel FET and the second constant current source, and the source of the first P-channel FET is connected to the source of the first N-channel FET; a second P-channel FET having a source, a drain and a gate, wherein the drain of the second P-channel FET is connected to the sources of the first N-channel and first P-channel FETs, the gate of the second P-channel FET is connected to the drain of the second N-channel FET and the first constant current source, and the source of the second P-channel FET is connected to an output from a primary voltage regulator; the first and second N-Channel FETs, the first P-channel FET and the first and second constant current sources comprise a low power secondary voltage regulator having an output, the output is the connected sources of the first P-channel FET and the first N-channel FET; and a maintained voltage core logic of an integrated circuit device, wherein the maintained voltage core logic is coupled to and receives its operating voltage from the primary voltage regulator through the second P-channel FET when the integrated circuit device is in an operational mode; and the maintained voltage core logic receives its operating voltage from the output of the low power secondary voltage regulator when the integrated circuit device is in a low power standby sleep mode.

According to yet another specific example embodiment of this disclosure, a low power voltage regulator for supplying operating voltage to circuits required to maintain data and/or be operational during an integrated circuit device low power sleep mode, comprises: an amplifier having a non-inverting input, an inverting input, and an output; an N-channel field effect transistor (FET) having a source, a drain and a gate, wherein the drain of the N-channel FET is connected to a supply voltage source, and the gate of the N-channel FET is connected to the output of the amplifier; the non-inverting input of the amplifier is connected to a voltage approximately equal to a threshold voltage of the N-channel FET; a constant current source connected to a supply voltage common; a first P-channel FET having a source, a drain and a gate, wherein the drain and gate of the first P-channel FET are connected to the inverting input of the amplifier and the constant current source, and the source of the first P-channel FET is connected to the source of the N-channel FET; the amplifier, the N-Channel FET, the first P-channel FET, and the constant current source comprise a low power secondary voltage regulator having an output, wherein the output is the connected sources of the first P-channel FET and the N-channel FET; and a maintained voltage core logic of an integrated circuit device connected to the output of the low power secondary voltage regulator. The low power voltage regulator may further comprise: a second P-channel FET having a source, a drain and a gate, wherein the drain of the second P-channel FET is connected to the sources of the N-channel and first P-channel FETs, the gate of the second P-channel FET is connected to the output of the amplifier and the gate of the N-channel FET, and the source of the second P-channel FET is connected to an output from a primary voltage regulator; wherein the maintained voltage core logic is coupled to and receives its operating voltage from the primary voltage regulator through the second P-channel FET when the integrated circuit device is in an operational mode; and wherein the maintained voltage core logic receives its operating voltage from the output of the low power secondary voltage regulator when the integrated circuit device is in a low power standby sleep mode.

According to still another specific example embodiment of this disclosure, a low power voltage regulator for supplying back-up voltage to circuits required to maintain data and/or be operational during an integrated circuit device low power sleep mode comprises: an amplifier having a non-inverting input, an inverting input, and an output; a N-channel field effect transistor (FET) having a source, a drain and a gate, wherein the drain of the N-channel FET is connected to a supply voltage source, the gate of the N-channel FET is connected to the first constant current source and the first constant current source is connected to the output of the amplifier; the non-inverting input of the amplifier is connected to a voltage approximately equal to a threshold voltage of the N-channel FET; a constant current source connected to a supply voltage common; a first P-channel FET having a source, a drain and a gate, wherein the drain and gate of the first P-channel FET are connected to the inverting input of the amplifier and the constant current source, and the source of the first P-channel FET is connected to the source of the N-channel FET; the amplifier, the N-Channel FET, the first P-channel FET, and the constant current source comprise a low power secondary voltage regulator having an output, wherein the output is the connected sources of the first P-channel FET and the N-channel FET; a maintained voltage core logic of an integrated circuit device connected to the output of the low power secondary voltage regulator; and a second P-channel FET having a source, a drain and a gate, wherein the drain of the second P-channel FET is connected to the sources of the N-channel and first P-channel FETs, the gate of the second P-channel FET is connected to the output of the amplifier and the gate of the N-channel FET, and the source of the second P-channel FET is connected to an output from a primary voltage regulator; wherein the maintained voltage core logic is coupled to and receives its operating voltage from the primary voltage regulator through the second P-channel FET when the integrated circuit device is in an operational mode; and wherein the maintained voltage core logic receives its operating voltage from the output of the low power secondary voltage regulator when the integrated circuit device is in a low power standby sleep mode.

BRIEF DESCRIPTION OF THE DRAWINGS

A more complete understanding of the present disclosure thereof may be acquired by referring to the following description taken in conjunction with the accompanying drawings wherein.

Figure 1:
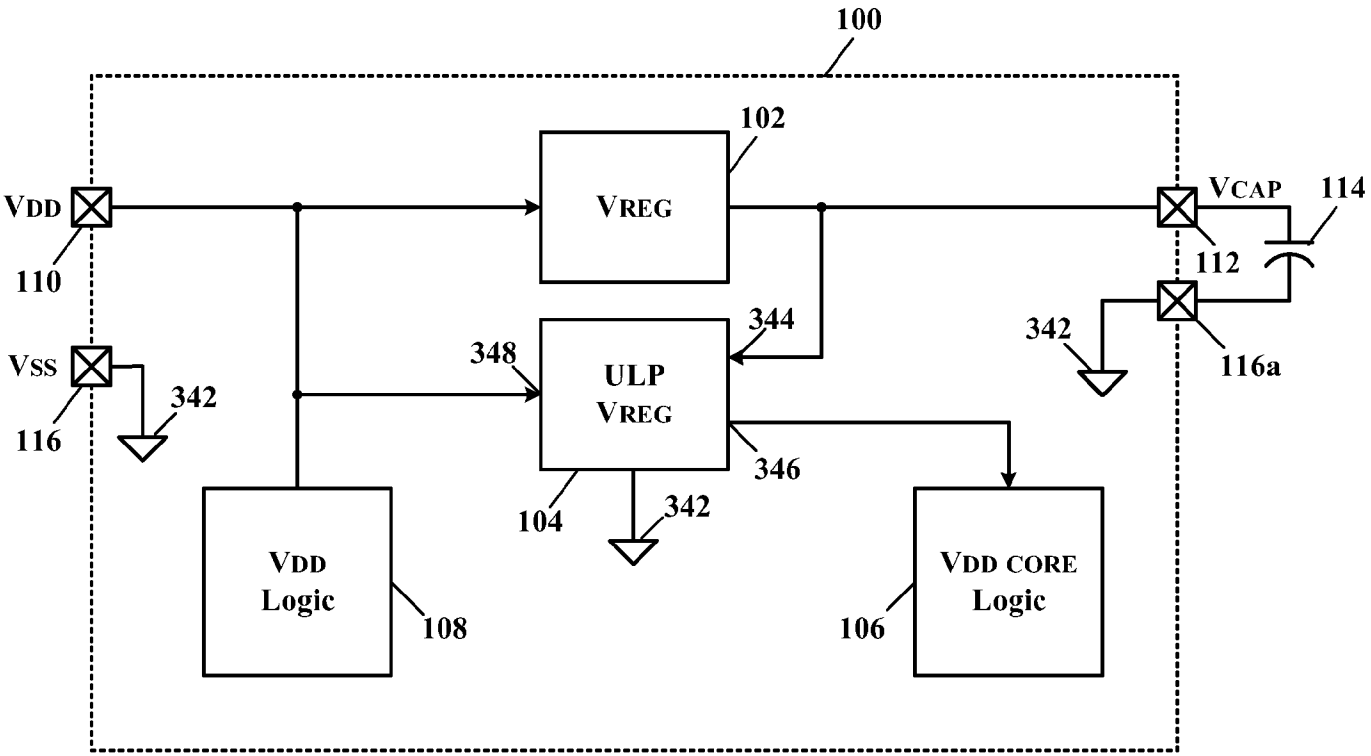
FIG. 1 illustrates a schematic block diagram of an integrated circuit device having a primary voltage regulator and an ultra-low power secondary voltage regulator for providing data retention and dynamic power for continuous operation of certain circuits when the integrated circuit device is in a low power sleep mode, according to the teachings of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawing, the details of specific example embodiments are schematically illustrated. Like elements in the drawings will be represented by like numbers, and similar elements will be represented by like numbers with a different lower case letter suffix.

Referring to FIG. 1, depicted is a schematic block diagram of an integrated circuit device having a primary voltage regulator and an ultra-low power secondary voltage regulator for providing data retention and dynamic power for continuous operation of certain circuits when the integrated circuit device is in a low power sleep mode, according to the teachings of this disclosure. An integrated circuit device 100 comprises digital logic 108 (and possibly analog circuits e.g., a mixed signal device), core logic 106 that remains active even when the integrated circuit device 100 is in a low power sleep mode, a primary voltage regulator 102, and an ultra-low power secondary voltage regulator 104.

Both voltage regulators 102 and 104 are powered from an external power source, $V_{DD}$, connected at node 110, e.g., a battery. When the integrated circuit device 100 is in an operational mode the primary voltage regulator 102 supplies operating voltage to the core logic 106 among other circuits within the device 100. However, when the integrated circuit device 100 goes into a low power sleep mode most current consuming logic circuits and the primary voltage regulator 102 generally will be inhibited (shutdown) so as to substantially reduce current consumption within the device 100. The core logic 106 (e.g., back-up domain) must remain operational during the low sleep mode of the device 100, e.g., a real time clock and calendar (RTCC), etc.

External connection nodes of the integrated circuit device 100 may be for example but are not limited to a supply voltage node 110, $V_{DD}$, a supply common node 116, $V_{SS}$, and a regulator stabilization capacitor node 112.

Figure 2:
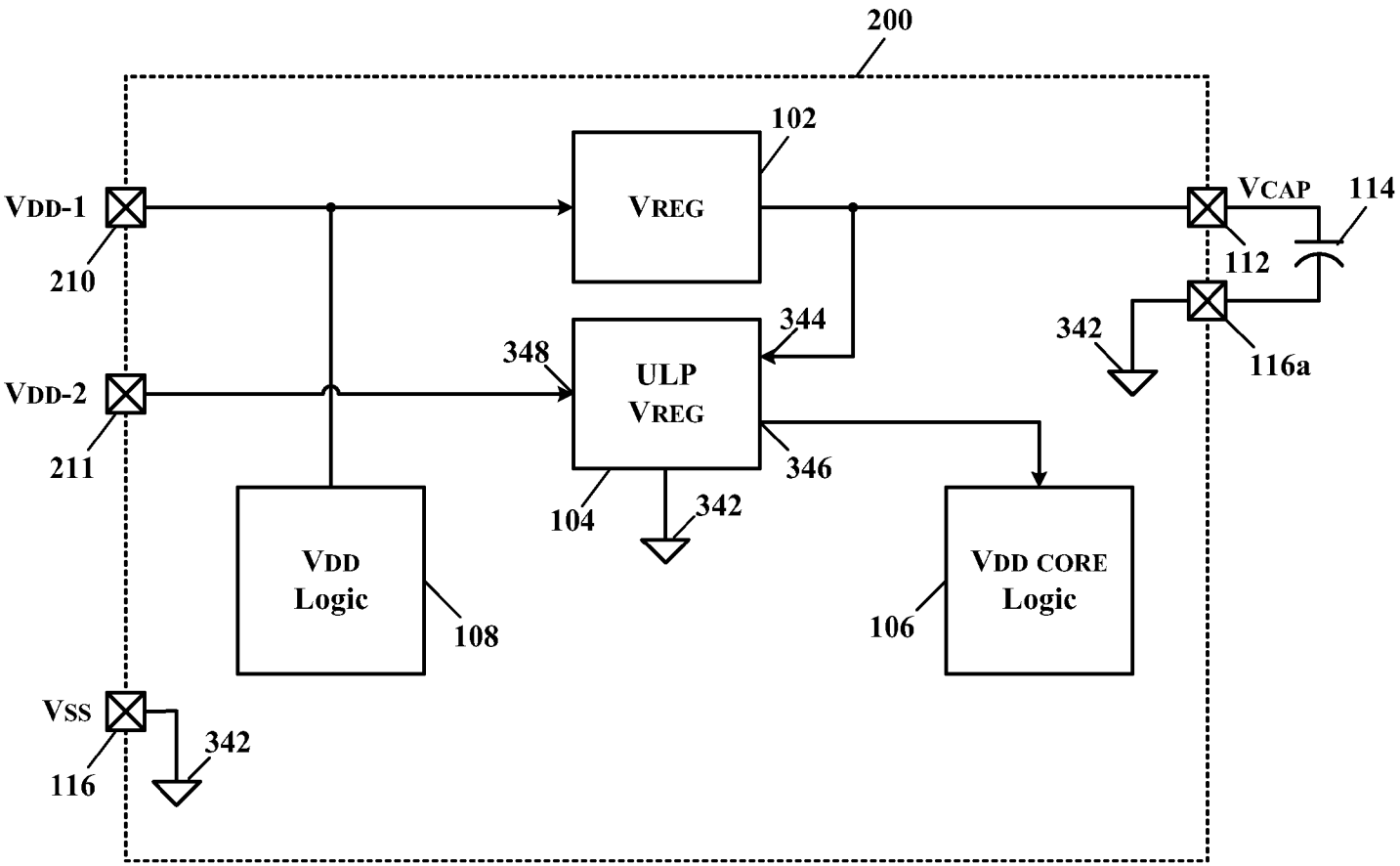
FIG. 2 illustrates a schematic block diagram of an integrated circuit device having a primary voltage regulator and an ultra-low power secondary voltage regulator connected to independent voltage sources and providing for data retention and dynamic power for continuous operation of certain circuits when the integrated circuit device is in a low power sleep mode, according to the teachings of this disclosure.

Referring to FIG. 2, depicted is a schematic block diagram of an integrated circuit device having a primary voltage regulator and an ultra-low power secondary voltage regulator connected to independent voltage sources and providing for data retention and dynamic power for continuous operation of certain circuits when the integrated circuit device is in a low power sleep mode, according to the teachings of this disclosure. An integrated circuit device 200 comprises digital logic 108 (and possibly analog circuits e.g., a mixed signal device), core logic 106 that remains active even when the integrated circuit device 200 is in a low power sleep mode, a primary voltage regulator 102, and an ultra-low power secondary voltage regulator 104.

Voltage regulator 102 is powered from a first external power source, $V_{DD}$-1, and voltage regulator 104 is powered from a second external power source, $V_{DD}$-2, e.g., a battery. When the integrated circuit device 200 is in an operational mode the primary voltage regulator 102 supplies operating voltage to the core logic 106 among other circuits within the device 200. However, when the integrated circuit device 200 goes into a low power sleep mode most current consuming logic circuits and the primary voltage regulator 102 generally will be inhibited (shutdown) so as to substantially reduce current consumption within the device 200. The core logic 106 (e.g., back-up domain) must remain operational during the sleep mode of the device 200, e.g., a real time clock and calendar (RTCC), etc.

External connection nodes of the integrated circuit device 100 may be for example but are not limited to a main supply voltage node 210, $V_{DD}$-1, a secondary supply voltage node 211, $V_{DD}$-2, a supply common node 116, $V_{SS}$, and a regulator stabilization capacitor node 112.

Figure 3:
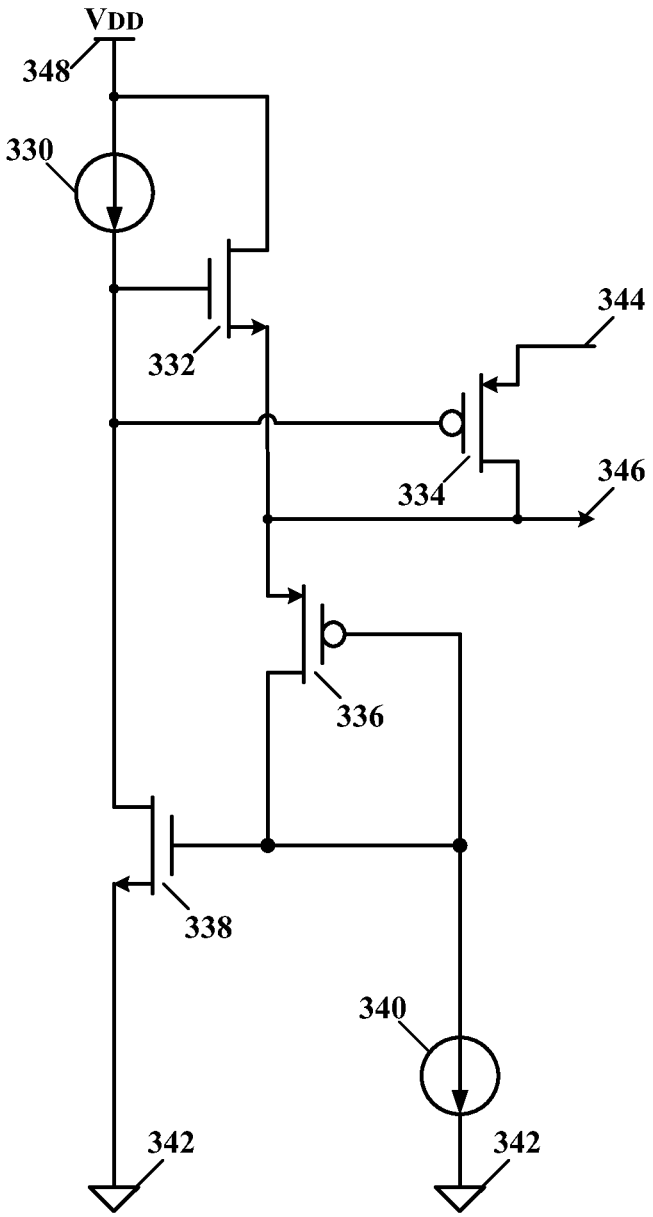
FIG. 3 illustrates a schematic diagram of an ultra-low power secondary voltage regulator of FIGS. 1 and 2, according to a specific example embodiment of this disclosure.

Referring to FIG. 3, depicted is a schematic diagram of an ultra-low power secondary voltage regulator of FIGS. 1 and 2, according to a specific example embodiment of this disclosure. A primary power source, $V_{DD}$, is coupled at node 348 and an output node 346 is approximately the sum of the threshold voltages, Vt, of transistors 336 and 338. The drain current of transistor 338 equals the current supplied by a constant current source 330. This arrangement turns off transistor 334 and biases transistor 332 at a level sufficient to provide a required amount of current to the output node 346. The feedback from this closed-loop system maintains the output node 346 at the desired voltage operating point for the voltage maintained core logic 106.

When a voltage from the primary voltage regulator 102 is applied to node 344, transistor 334 passes current to the output node 346 and raises the gate of transistor 338 above its threshold. As a result, the drain of transistor 338 is pulled lower, turning off transistor 332 and turning transistor 334 on hard. The result is an ultra-low power standby voltage regulator 104 that provides state-retention power to the core logic 106 when no power is available from the normal operational primary voltage regulator 102, and optionally may use the voltage from the primary voltage regulator 102 when power from it becomes available. Transistors 332 and 338 may be N-channel insulated gate (IG) metal oxide semiconductor (MOS) field effect transistors (FETs), and transistors 334 and 336 may be P-channel IG MOS FETs.

Figure 4:
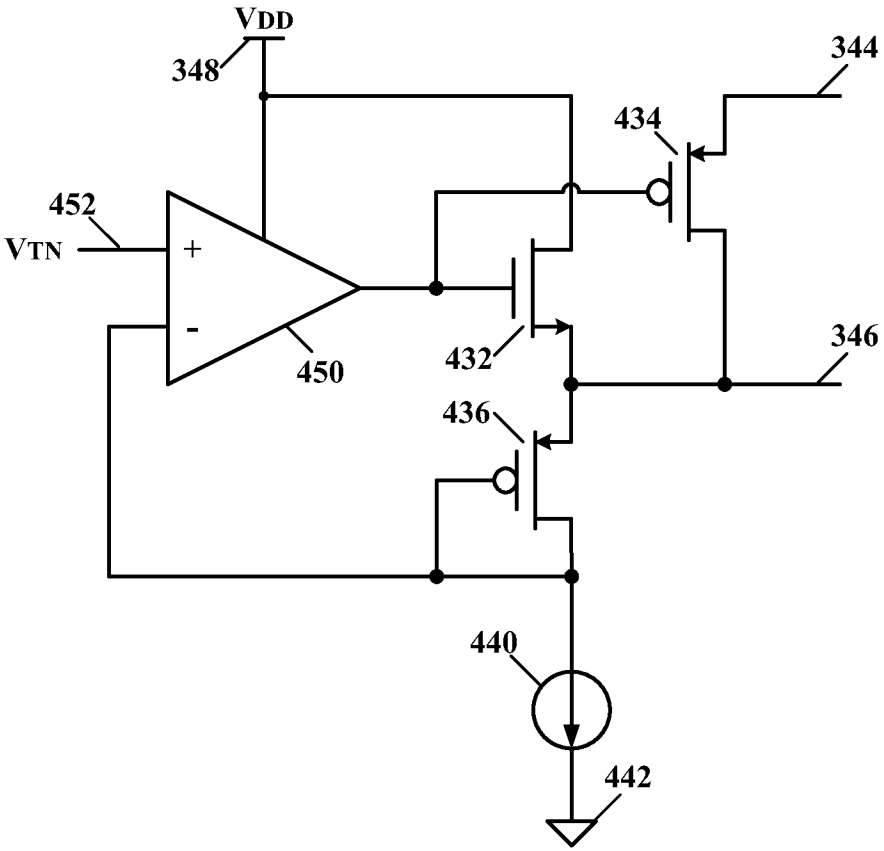
FIG. 4 illustrates a schematic diagram of an ultra-low power secondary voltage regulator of FIGS. 1 and 2, according to another specific example embodiment of this disclosure.

Referring to FIG. 4, depicted is a schematic diagram of an ultra-low power secondary voltage regulator of FIGS. 1 and 2, according to another specific example embodiment of this disclosure. A primary power source, $V_{DD}$, is couple at node 348 and an output node 346 is approximately the sum of the threshold voltages, Vt, of transistors 436 and 432. An inverting amplifier 450 has a negative input connected to the drain and gate of the transistor 436 and the current sink 440. A positive input of the inverting amplifier 450 is set to a voltage, $V_{TN}$, that is appropriate for the needs of the load. The output of the inverting amplifier 450 is connected to the gates of the transistors 432 and 434.

This arrangement turns off transistor 434 and biases transistor 432 at a level sufficient to provide a required amount of current to the output node 346. The feedback from this closed-loop system maintains the output node 346 at the desired voltage operating point for the voltage maintained core logic 106.

When a voltage from the primary voltage regulator 102 is applied to node 344, transistor 434 passes current to the output node 346 and raises the gate of transistor 432 above its threshold. As a result, the drain of transistor 432 is pulled lower, turning off transistor 432 and turning transistor 434 on hard. The result is an ultra-low power standby voltage regulator 104 that provides state-retention power to the core logic 106 when no power is available from the normal operational primary voltage regulator 102, and optionally may use the voltage from the primary voltage regulator 102 when power from it becomes available. Transistor 432 may be an N-channel insulated gate (IG) metal oxide semiconductor (MOS) field effect transistor (FET), and transistors 434 and 436 may be P-channel IG MOS FETs.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A low power voltage regulator for supplying operating voltage to circuits required to maintain data and/or be operational during an integrated circuit device low power sleep mode, comprising:

an amplifier having a non-inverting input, an inverting input, and an output;

an N-channel field effect transistor (FET) having a source, a drain and a gate, wherein the drain of the N-channel FET is connected to a supply voltage source, and the gate of the N-channel FET is connected to the output of the amplifier;

the non-inverting input of the amplifier is connected to a voltage approximately equal to a threshold voltage of the N-channel FET;

a constant current source connected to a supply voltage common;

a first P-channel FET having a source, a drain and a gate, wherein the drain and gate of the first P-channel FET are connected to the inverting input of the amplifier and the constant current source, and the source of the first P-channel FET is connected to the source of the N-channel FET;

the amplifier, the N-channel FET, the first P-channel FET, and the constant current source comprise a low power secondary voltage regulator having an output, wherein the output is the connected sources of the first P-channel FET and the N-channel FET; and a maintained voltage core logic of an integrated circuit device connected to the output of the low power secondary voltage regulator.

2. The low power voltage regulator according to claim 1, further comprising:

a second P-channel FET having a source, a drain and a gate, wherein the drain of the second P-channel FET is connected to the sources of the N-channel and first P-channel FETs, the gate of the second P-channel FET is connected to the output of the amplifier and the gate of the N-channel FET, and the source of the second P-channel FET is connected to an output from a primary voltage regulator;

wherein the maintained voltage core logic is coupled to and receives its operating voltage from the primary voltage regulator through the second P-channel FET when the integrated circuit device is in an operational mode; and wherein the maintained voltage core logic receives its operating voltage from the output of the low power secondary voltage regulator when the integrated circuit device is in a low power standby sleep mode.

3. The low power voltage regulator according to claim 2, wherein when no voltage is being supplied from the primary voltage regulator the second P-channel FET is turned off and the N-channel FET supplies operating current to the maintained voltage core logic.

4. A low power voltage regulator for supplying back-up voltage to circuits required to maintain data and/or be operational during an integrated circuit device low power sleep mode, comprising:

an amplifier having a non-inverting input, an inverting input, and an output;

a N-channel field effect transistor (FET) having a source, a drain and a gate, wherein the drain of the N-channel FET is connected to a supply voltage source, the gate of the N-channel FET is connected to the first constant current source and the first constant current source is connected to the output of the amplifier;

the non-inverting input of the amplifier is connected to a voltage approximately equal to a threshold voltage of the N-channel FET;

a constant current source connected to a supply voltage common;

a first P-channel FET having a source, a drain and a gate, wherein the drain and gate of the first P-channel FET are connected to the inverting input of the amplifier and the constant current source, and the source of the first P-channel FET is connected to the source of the N-channel FET;

the amplifier, the N-channel FET, the first P-channel FET, and the constant current source comprise a low power secondary voltage regulator having an output, wherein the output is the connected sources of the first P-channel FET and the N-channel FET;

a maintained voltage core logic of an integrated circuit device connected to the output of the low power secondary voltage regulator; and a second P-channel FET having a source, a drain and a gate, wherein the drain of the second P-channel FET is connected to the sources of the N-channel and first P-channel FETs, the gate of the second P-channel FET is connected to the output of the amplifier and the gate of the N-channel FET, and the source of the second P-channel FET is connected to an output from a primary voltage regulator;

wherein the maintained voltage core logic is coupled to and receives its operating voltage from the primary voltage regulator through the second P-channel FET when the integrated circuit device is in an operational mode; and wherein the maintained voltage core logic receives its operating voltage from the output of the low power secondary voltage regulator when the integrated circuit device is in a low power standby sleep mode.

5. The low power voltage regulator according to claim 4, wherein when no voltage is being supplied from the primary voltage regulator the second P-channel FET is turned off and the N-channel FET supplies operating current to the maintained voltage core logic.

* * * * *